US006733149B1

(12) United States Patent
Chuang

(10) Patent No.: US 6,733,149 B1
(45) Date of Patent: May 11, 2004

(54) ILLUMINATING SOUNDING BALL

(76) Inventor: Shih-Kuan Chuang, 4F-1, No. 12, Lane 205, Chung-Shan Rd., Tainan (TW)

( * ) Notice: Subject to any disclaimer, the term of this patent is extended or adjusted under 35 U.S.C. 154(b) by 0 days.

(21) Appl. No.: 10/337,975

(22) Filed: Jan. 8, 2003

(51) Int. Cl.[7] ..... F21V 33/00

(52) U.S. Cl. ..... 362/86; 362/253; 362/806; 446/175; 473/571

(58) Field of Search ..... 362/253, 86, 806; 446/409, 175; 473/571

(56) References Cited

U.S. PATENT DOCUMENTS 2,942,379 A * 6/1960 Oman et al. ..... 446/409
4,737,134 A * 4/1988 Rumsey ..... 446/409
5,445,375 A * 8/1995 Sweeny ..... 473/570
5,533,920 A * 7/1996 Arad et al. ..... 446/409
5,816,885 A * 10/1998 Goldman et al. ..... 446/397
6,428,432 B1 * 8/2002 Kachel ..... 473/570

* cited by examiner

*Primary Examiner*—Thomas M. Sember
(74) *Attorney, Agent, or Firm*—Fei-Fei Chao; Venable LLP

(57) ABSTRACT

An illuminating and sounding ball includes a translucent solid first hemisphere, an opaque second hemisphere combined with the translucent solid first hemisphere to become a ball. The opaque second hemisphere has a chamber defined therein. An illuminating and sounding device is received in the chamber to illuminate and sound when the ball is bouncing. A background index paper is placed on top of the illuminating and sounding device. A 3D toy is received in the chamber and placed on top of the background index paper.

4 Claims, 2 Drawing Sheets

ILLUMINATING SOUNDING BALL

BACKGROUND OF THE INVENTION

1. Field of the Invention

The present invention relates to an illuminating sounding ball, and more particularly to a ball that not only is able to bounce but also is able to illuminate and sound while bouncing.

2. Description of Related Art

A conventional ball normally is able to bounce up and down, which is quite dull and attracts little attention to small children. That is, the small children turn away their attentions to something else which is more interesting to them after playing the conventional ball for only a short period of time.

To overcome the shortcomings, the present invention tends to provide an improved illuminating sounding ball to mitigate and obviate the aforementioned problems.

SUMMARY OF THE INVENTION

The primary objective of the present invention is to provide an improved illuminating sounding ball which is able to illuminate and make sounds when the ball is bouncing up and down.

In order to accomplish the foregoing objective, the illuminating sounding ball of the present invention has a translucent solid first hemisphere, a 3D toy, a background index paper, a translucent cover, an illuminating and sounding device and a second hemisphere having a chamber defined to receive therein the 3D toy, the background index paper, the translucent cover and the illuminating and sounding device. With such an arrangement, the illuminating and sounding ball is able to illuminate and sound when being bounced.

Other objects, advantages and novel features of the invention will become more apparent from the following detailed description when taken in conjunction with the accompanying drawings.

DETAILED DESCRIPTION OF THE PREFERRED EMBODIMENT

Figure 1:
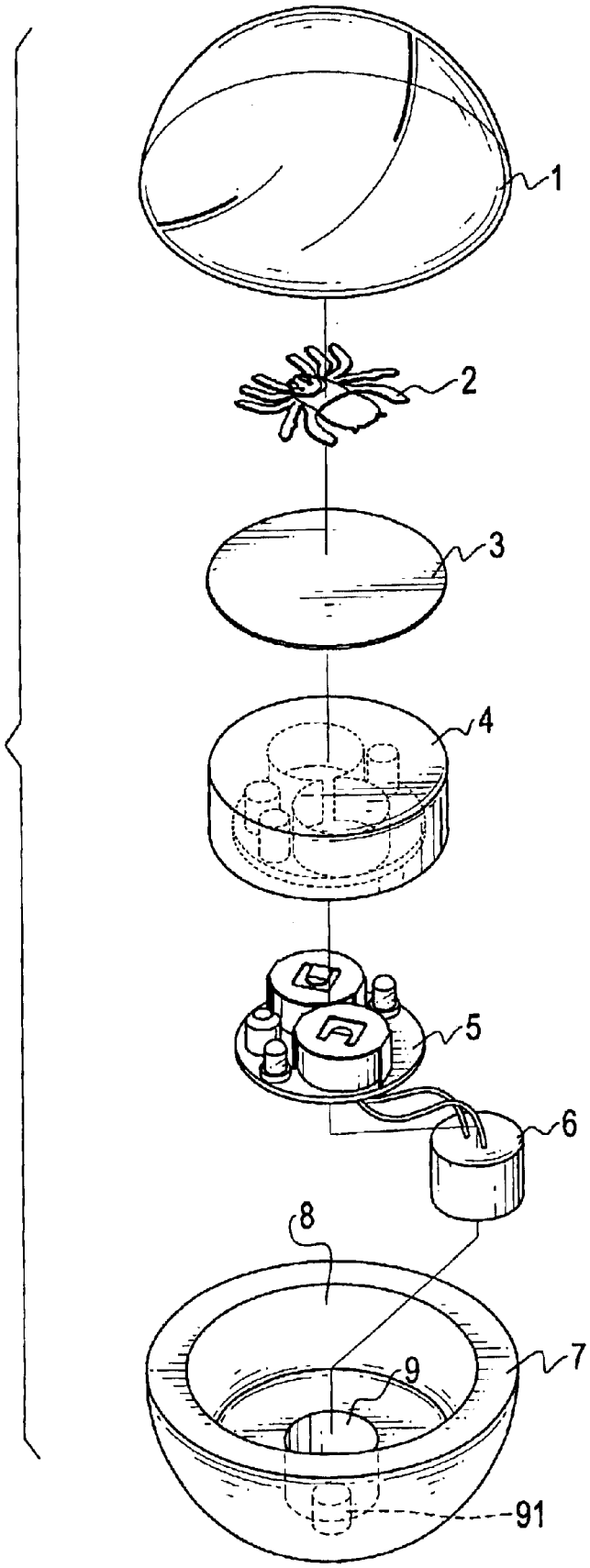
FIG. 1 is an exploded perspective view of the present invention.
Figure 2:
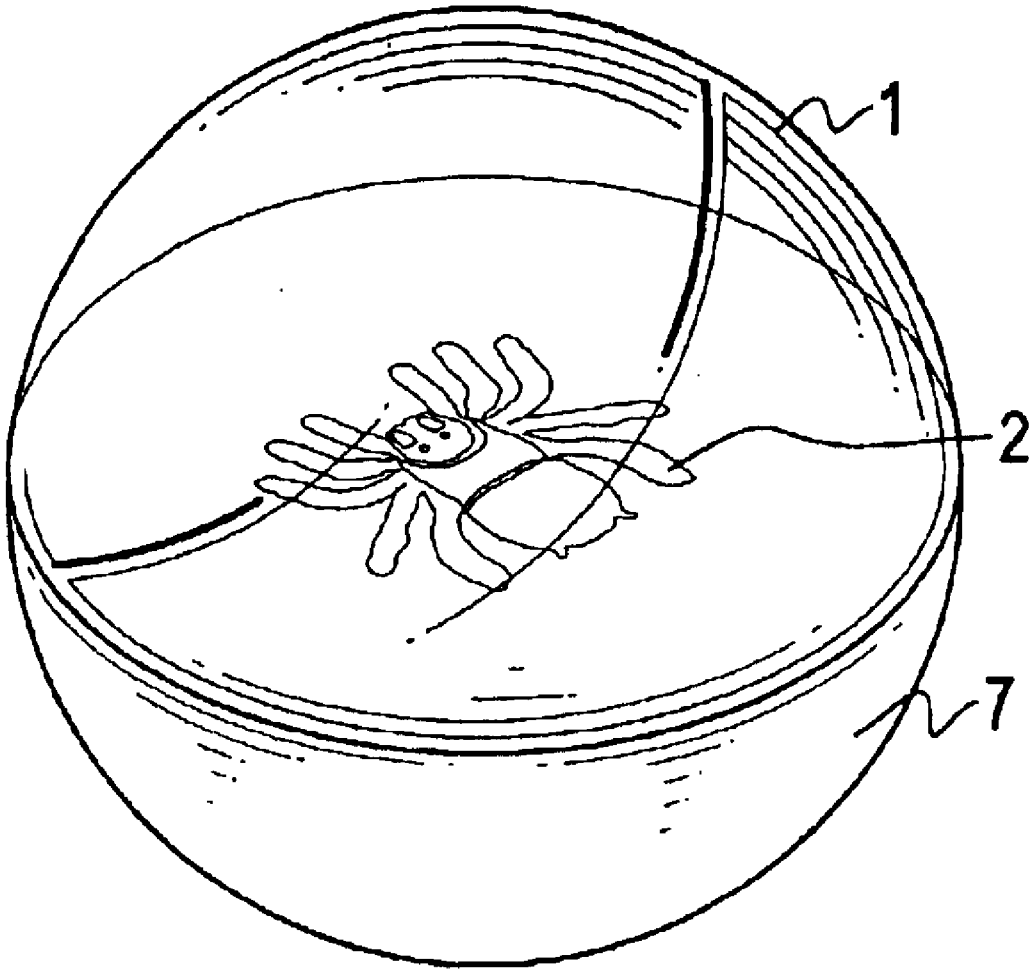
FIG. 2 is a perspective view of the illuminating and sounding ball in assembly.

With reference to FIGS. 1 and 2, the illuminating and sounding ball in accordance with the present invention has a translucent solid first hemisphere (1), a 3D toy (2), a background index paper (3), a translucent cover (4), an illuminating and sounding device (5) and an opaque second hemisphere (7). The opaque second hemisphere (7) has a chamber (8) defined to receive therein the 3D toy (2), the background index paper (3), the translucent cover (4) and the illuminating and sounding device (5).

Furthermore, the opaque second hemisphere (7) has a recess (9) defined in a bottom face defining the chamber (8) to receive therein a buzzer (6) of the illuminating and sounding device (5) and a slit (91) defined through the periphery of the opaque second hemisphere (7) to communicate with the recess (9). The buzzer (6) is electrically connected to the illuminating and sounding device (5) so that when the buzzer (6) is received in the recess (9), the buzzing sounding from the buzzer (6) is able to be transmitted out of the opaque second hemisphere (7).

Still, the background index paper (3) is able to be painted with all kinds of pictures to match with the 3D toy (2). The translucent cover (4) is sandwiched between the illuminating and sounding device (5) and the background index paper (3) such that light coming out from the illuminating and sounding device (5) is softened through the background index paper (3).

When the solid first hemisphere (1) and the opaque second hemisphere (7) are combined after the 3D toy (2), the background index paper (3), the translucent cover (4) and the illuminating and sounding device (5) are received in the chamber (8), the illuminating and sounding device (5) is able to illuminate and sound. The illumination and the sound can be visible from the translucent first hemisphere (1) and heard from the slit (91) respectively.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An illuminating and sounding ball comprising:

a translucent solid first hemisphere;

an opaque second hemisphere combined with the translucent solid first hemisphere to become a ball, the opaque second hemisphere having a chamber defined therein and a recess defined in a bottom face defining the chamber to receive therein a buzzer and a slit defined through a periphery of the opaque second hemisphere so as to transmit sound from the buzzer;

an illuminating and sounding device received in the chamber to illuminate and sound when the ball is bouncing;

a background index paper placed on top of the illuminating and sounding device; and a 3D toy received in the chamber and placed on top of the background index paper.

2. The illuminating and sounding ball as claimed in claim 1 further comprising a translucent cover sandwiched between the illuminating and sounding device and the background index paper to soften light from the illuminating and sounding device.

3. An illuminating and sounding ball comprising:

a translucent solid first hemisphere;

an opaque second hemisphere combined with the translucent solid first hemisphere to become a ball, the opaque second hemisphere having a chamber defined therein;

an illuminating and sounding device received in the chamber to illuminate and sound when the ball is bouncing;

a background index paper placed on top of the illuminating and sounding device;

a translucent cover sandwiched between the illuminating and sounding device and the background index paper to soften light from the illuminating and sounding device; and a 3D toy received in the chamber and placed on top of the background index paper.

4. The illuminating and sounding ball as claimed in claim 3, wherein the opaque second hemisphere further comprises a recess defined in a bottom face defining the chamber to receive therein a buzzer of the illuminating and sounding device and a slit defined through a periphery of the opaque second hemisphere so as to transmit sound from the buzzer.

* * * * *